US005628512A

United States Patent [19]

Chan

[11] Patent Number: 5,628,512

[45] Date of Patent: May 13, 1997

[54] SIMULATED SPACE STATION PUZZLE GAME

[76] Inventor: Wai K. Chan, 3 B, Mom Tat Wan, Lamma Island, Hong Kong

[21] Appl. No.: 633,911

[22] Filed: Apr. 15, 1996

[51] Int. Cl.[6] ..... A63F 9/08

[52] U.S. Cl. ..... 273/153 S; 273/155

[58] Field of Search ..... 273/153 S, 155, 273/153 R, 156, 157 R, 154

[56] References Cited

U.S. PATENT DOCUMENTS

| | | | |
|---|---|---|---|
| 4,708,345 | 11/1987 | Ayers | 273/153 S |
| 4,881,738 | 11/1989 | Ayers | 273/153 S |
| 5,267,731 | 12/1993 | Gruber | 273/153 S |
| 5,370,394 | 12/1994 | Huncaga | 273/153 S |

FOREIGN PATENT DOCUMENTS

| | | | |
|---|---|---|---|
| 1124987 | 11/1984 | U.S.S.R. | 273/153 S |
| 1512641 | 10/1989 | U.S.S.R. | 273/153 S |

*Primary Examiner*—Steven B. Wong
*Attorney, Agent, or Firm*—David W. Wong

[57] ABSTRACT

A skill challenging puzzle game shaped like an space station comprises of three spherical members rotatably mounted on a circular disc-shaped main body. Each spherical member is rotatably mounted on a horizontal axis located at the periphery of the main body and consists of eight equal size sectors. The disc-shaped main body consists of an inverted upper saucer and a lower saucer mounted together and rotatable horizontally relative to each other about a central axis such that the upper portion of the spherical members may be scrambled from or matched with selected lower portion of the spherical members. The matched spherical members may be additionally rotatable relative to their horizontal axes to obtain various challenging combinations of colours or patterns provided on the spherical members.

19 Claims, 2 Drawing Sheets

SIMULATED SPACE STATION PUZZLE GAME

BACKGROUND OF THE INVENTION

This invention relates to a puzzle game object which provides a high degree of test and challenge to a player's skill and patience. The object has an attractive space station overall artistic appearance and structure so as to captivate the player's interest and to provide a great amount of entertainment.

Heretofore, there have been a large number of puzzle game objects which require the player to scramble and to match various pieces therein to obtain various desired combinations of colours and/or patterns. The well known Rubic cube is one example of such puzzle games. Another puzzle game comprises of a plurality of square pieces slidably mounted within a rectangular frame. The square pieces have various colours and/or patterns thereon such that the square pieces may be slidably scrambled or arranged within the frame to obtain various chosen combinations of colours and/or patterns. Some of such prior art puzzle games such as the Rubic cube provide a high degree of test to the player's patience and skill and they have a multitude of combinations of movements; however, they are unattractive in appearance and are unable to sustain the player's interest. Moreover, these puzzle games are far too complex in construction such that they are expensive and difficulty to fabricate, while others are too simple in construction and have a limited amount of movements such that they offer little challenge to the player and do not render too much entertainment value so that the player would quickly lose interest in the game.

SUMMARY OF THE INVENTION

It is a principal object of the present invention to provide a puzzle game object which provides a high degree of challenge to the player's skill.

It is another object of the present invention to provide a puzzle game object which has an attractive and artistic appearance that can sustain the player's interest as well as to provide an entertaining object or toy.

It is yet another object of the present invention to provide a puzzle game object having few component parts and is simple to fabricate and assemble.

It is still another object of the present invention to provide a puzzle game object wherein the components afford a large number of variations of movements.

The puzzle game object of the present invention comprises a disc-shaped main body simulating a space station. The main body comprises an upper inverted saucer and a lower saucer mounted together on a central axis, and the upper and lower saucers are rotatably horizontally relative to one another on this central axis. A plurality of spherical members are rotatably mounted on horizontal axes disposed at the diameter if a plurality of semi-circular bays evenly located at the periphery of the main body. Each spherical member has eight equal sectors; and the spherical member is rotatable relative to its axis such that one group of four sectors therein may be located at the upper saucer of the main body while the other group of the other four sectors are located at the lower saucer of the main body. The upper saucer and lower saucer may be rotated to match selected groups of four sectors at the upper saucer with the other selected groups of four sectors at the lower saucer, and the spherical members thus matched may additionally be rotated to change the position of the lower and upper groups.

BRIEF DESCRIPTION OF THE DRAWINGS

Other objects and advantages of the present invention will become apparent from the following detailed description of the preferred embodiments thereof in connection with the accompanying drawings, in which.

DETAILED DESCRIPTION OF THE PREFERRED EMBODIMENTS

Figure 1:
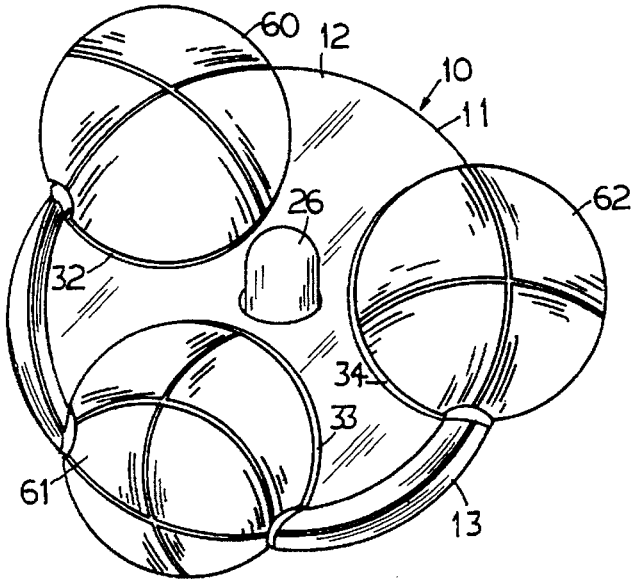
FIG. 1 is a perspective overall elevation view of the puzzle game according to the present invention.
Figure 2:
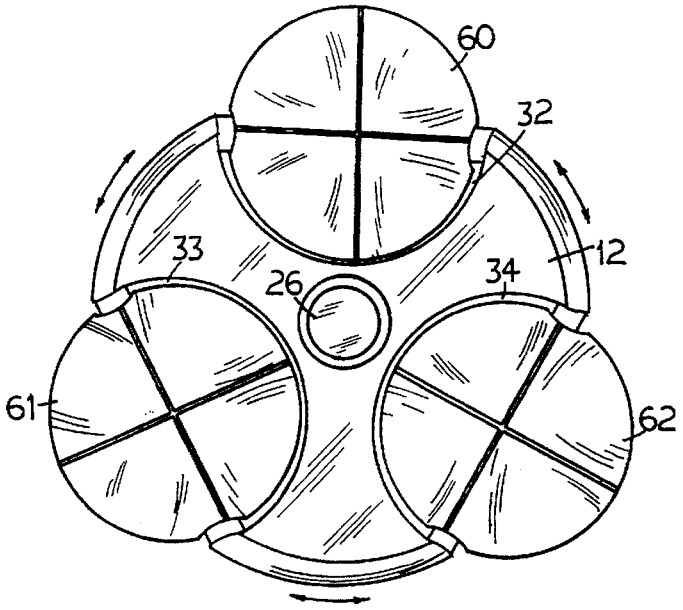
FIG. 2 is a top elevation view of thereof.
Figure 3:
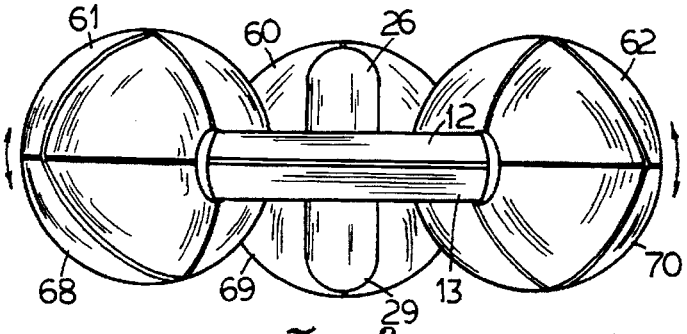
FIG. 3 is a perspective side elevation view thereof.
Figure 4:
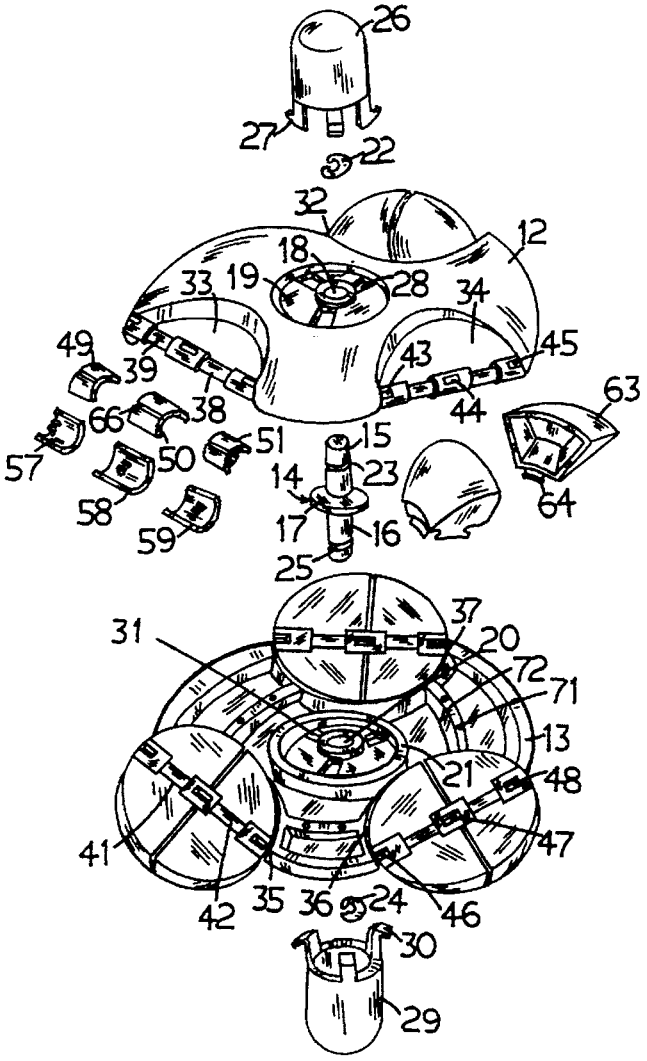
FIG. 4 is a exploded perspective elevation view of the puzzle game of the present invention showing the component parts therein.
Figure 5:
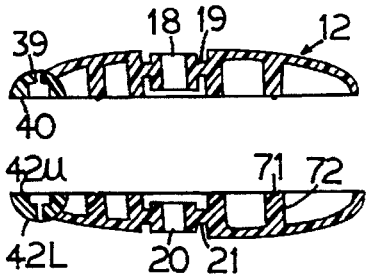
FIG. 5 is an isolated cross section side elevation view of the upper lower saucers of the main body of the puzzle game.

With reference to the drawings wherein like reference numerals designate corresponding parts in the various views, the puzzle game 10 of the present invention has a disc-shaped main body 11 which consists of an upper inverted saucer 12 and a lower saucer 13 having a mirror image of each other and are rotatably mounted together on a rotary axis 14 such that the upper inverted saucer 12 and the lower saucer 13 are rotatable relative to each other about the rotary axis 14. The rotary axis 14 as best shown in FIG. 4 has an upper shaft portion 15, a lower shaft portion 16 and a support plate 17. The upper shaft portion 15 is slidably and rotatably engageable with a central opening 18 formed at a hub portion 19 in the upper inverted saucer 12. The lower shaft portion 16 is similarly slidably and rotatably engageable with a central opening 20 formed at a hub portion 21 in the lower saucer 13. The upper inverted saucer 12 is maintained in the mounted position by a slip ring 22 engaging with an annular groove 23 formed on the upper shaft portion 15, while the lower saucer 13 is maintained in the mounted position by a second slip ring 24 engaging with an annular groove 25 formed on the lower shaft portion 16 of the rotary axis 14. The support plate 17 cooperates with the slip rings 22 and 24 to prevent the upper inverted saucer 12 and lower saucer 13 from sliding up and down the rotary axis 14 so that the upper inverted saucer 12 and lower saucer 13 are abutting each other in the mounted position. A cap 26 is mounted to the hub portion 19 of the upper inverted saucer 12 to cover the upper shaft 15 in the mounted position. The cap 26 has a plurality of L-shaped spring tabs 27 engageable in a snap action with openings 28 formed in the hub portion 19 of the upper inverted saucer 12. Similarly, the lower shaft 25 in the mounted position is covered by a second cap 29 having a plurality of L-shaped spring tabs 30 engageable in a snap action with openings 31 formed in the hub portion 21 of the lower saucer 13.

Figure 6:
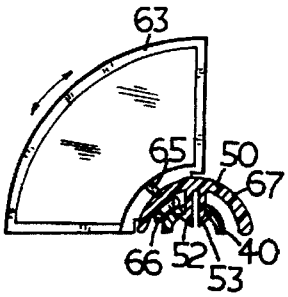
FIG. 6 shows an isolated side elevation view of a sector of the spherical member slidably engaged with upper half of the coaxial sleeve mounted on the upper half of the axis for mounting the spherical member with the view taken from a plane transverse to the axis.

At least two and preferably three semi-circular bays 32, 33 and 34 are formed in even intervals around the peripheral portion of the upper inverted saucer 12, and similarly semi-circular bays 35, 36 and 37 are formed around the peripheral portion of the lower saucer 13. The upper inverted saucer 12 and lower saucer 13 may be rotated to align the semi-circular bays 32, 33, and 34 with the semi-circular bays 35, 36, and 37. A mounting shaft 38 is located at the diameter of each of the semi-circular bays 32, 33, and 34 in the upper inverted saucer 12. As best shown in FIGS. 4 and 6, each mounting shaft 38 has semi-circular upper surface 39 and a flat bottom surface 40. Similarly, a mounting shaft 41 is located at the diameter of the semi-circular bays 35, 36, and 37 in the lower saucer 13. The mounting shaft 41 in each semi-circular bays 35, 36, and 37 has a semi-circular lower Surface 42L and a flat upper surface 42U. When the semi-circular bays in the upper inverted saucer are aligned with the semi-circular bays in the lower saucer, the mounting shafts 38 would cooperate with the mounting shafts 41 to form a cylindrical mounting shaft in each semi-circular bays in the main body 11 by the mating saucers. Three openings 43, 44, and 45 Are formed in the mounting shaft 38 in all the bays of the upper inverted saucer 12. The opening 43 and 45 are respectively located adjacent to the sides of the bay. The opening is located opening 44 is located at the centre of the shaft 38. The portions of the shaft 38 adjacent to the openings 43, 44 and 45 have a larger diameter than the remaining portion of the shaft 38. Similarly, openings 46, 47 and 48 are formed in the mounting shaft 41 in all the bays in the lower saucer 13. The openings 46 and 48 are located respectively adjacent to the two sides of the bay, and the opening 47 is located at the centre of the mounting shaft 41. Also, the portions of the mounting shaft 41 around the openings 46, 47, and 48 have a larger diameter than the remaining portion of the mounting shaft 41.

Three semi-circular covers 49, 50 and 51 are mounted over the larger diameter portions of the mounting shaft 38. Each one of the covers 49, 50 and 51 has two L-shaped tabs 52 and 53 engaging respectively with the openings 43, 44, and 45 to secure the semi-circular covers 49, 50 and 51 at the mounted position. The inner diameter of the semi-circular covers 49, 50 and 51 is equal to the diameter of the larger portions of the mounting shaft 38 and they are longer in length than these larger portions of the mounting shaft 38 so that, at the mounted positions of the semi-circular covers, arcuate; gaps 54 are formed between the end portions of the semi-circular covers 49 and 51 extending beyond the larger portions of the mounting shaft 38 around the side openings 43 and 45 in the upper inverted saucer 12. Also, similar arcuate gaps 55 and 56 are formed between the end portions of the semi-circular cover 50 extending beyond the larger portion around the centre opening 44 of the mounting shaft 38. Three semi-circular covers 57, 58, and 59 are mounted on the larger portions of the mounting shaft 41 in each one of the bays 35, 36 and 37 in the lower saucer 13 in the same manner.

Figure 7:
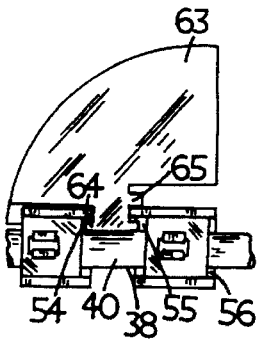
FIG. 7 is another isolated side elevation view of a sector of the spherical member taken from a plane parallel to the axis and showing the slidable engagement between the sector and the coaxial sleeve mounted on the upper half of the axis.

Three semi-spheres 60, 61 and 62 are located in the bays 32, 33 and 34 respectively in the upper inverted saucer 12. Each semi-spheres 60, 61 and 62 consists of four quarter spherical pieces 63 mounted to the mounting shaft 38 as best shown in FIGS. 6 and 7. An arcuate plate 64 is provided at the narrow base end of each quarter spherical piece 63 such that a quarter spherical piece may be mounted onto the mounting shaft 38 such as by slidably engaging the arcuate plate 64 with the gaps 54 and 55. All four quarter spherical pieces 63 may thus be slidably mounted to the mounting shaft 38. A small downwardly extending projection 65 is provided in a spaced manner above the arcuate plate 64, which is engageable with either one of two longitudinal grooves 66 and 67 formed on the upper surface of the semi-circular cover 50 and 58 to provide detent stops in the sliding movement of the quarter spherical pieces over the mounting shafts 38. In the same manner, three semi-spheres 68, 69, and 70 each consisting of four quarter spherical pieces identical to the quarter spherical piece 63 are mounted onto the mounting shaft 41 in each of the three bays 35, 36 and 37 in the lower saucer 13.

Depressions 71 are formed on the upper surface of arcuate ridges 72 provided in the lower saucer 13 and complementary projections are formed on the lower surface similar downward extending arcuate ridges provided in the upper inverted saucer 12 such that the projections in the upper inverted saucer 12 are engageable with the depressions 71 when the upper inverted saucer 12 and lower saucer 13 are rotated relative to each other to provide detent stops in each of the four positions at which the semi-spheres in the upper inverted saucer 12 are aligned with the semi-spheres in the lower saucer 13. Also, since the semi-spheres in the upper inverted saucer 12 and the semi-spheres in the lower saucer are identical in construction, whenever they are aligned to form three complete spheres, each sphere may be rotated relative to the mated mounting shafts 38 and 41 such that a pair of the quarter spherical pieces 63 in the upper inverted saucer 12 is moved into the lower saucer 13 while a diametrically opposite pair in the lower saucer 13 is moved into the upper inverted saucer 12. Thus, by rotating the spheres in one direction or in the opposite direction, a pair of quarter spherical pieces and the diametrically opposite pair of quarter spherical pieces would move from one saucer into the other saucer.

The quarter spherical pieces in each sphere may have a different colour or may have selected patterns provided on their outer surface. For example, the quarter spherical pieces in one sphere may be red, the second sphere may be green and the third one may be blue. The colour of the spheres may be scrambled by rotating the upper inverted saucer 12 relative to the lower saucer 13 such that different colour semi-spheres in one saucer align with those in the other saucer. The colour may be further scrambled by then rotating the spheres to move pairs of quarter spherical pieces from one saucer into the other. An exemplary game in testing the player's patience is to re-arrange such scrambled colour spheres back to the spheres of the same colour in each bay. In order to reach such goal the player must be capable of manipulating the game by rotating the upper and lower saucer and the various spheres in a logically manner. Similarly, when designed patterns are provided on the surface of the sphere, the player must be capable of re-arranging the scrambled patterned back to the original pattern.

The surface of the main body 11 may be provided with an artistic appearance simulating the surface appearance of a space craft or station such that the game may serve as a display object or toy of a simulated space craft or station.

While the present invention has been shown and described in the preferred embodiment thereof, it will be apparent that various modifications can be made therein without departing from the spirit or essential attributes thereof, and it is desired therefore that only such limitations be placed thereon as are imposed by the appended claims.

What I claim is:

1. A puzzle game comprising an upper inverted saucer and a lower saucer rotatably mounted together with respect to a central axis, at least two semi-circular bays formed in even intervals in the periphery of said upper inverted saucer and lower saucer, said bays having a front opening distal from the centre of said upper inverted saucer and lower saucer, a shaft member disposed at the diameter of each of said semi-circular bays and positioned across said front opening of each of skid bays, spherical members rotatably mounted on said linear shaft member in said semi-circular bays, said spherical members having eight equal sectors with four upper sectors located in said upper inverted saucer, and four lower sectors located in said lower saucer, said upper inverted saucer and said lower saucer being rotatable to align selective four upper sectors with selective four lower sectors to form said spherical members, and said spherical members being rotatable to move a selective first pair of upper sectors in said four upper sectors into said lower saucer while a second pair of lower sectors in said lower saucer located diametrically opposite to said first pair of upper sectors is being moved into said upper inverted saucer.

2. A puzzle game according to claim 1 wherein said shaft member comprises an upper semi-cylindrical portion disposed in said upper inverted saucer, and a lower semi-cylindrical portion disposed in said lower saucer, said upper semi-cylindrical portion having a flat under-surface, and said lower semi-cylindrical portion having a flat top surface.

3. A puzzle game according to claim 2 wherein said shaft includes a first opening formed in a first portion therein located adjacent to one side of said bay, a second opening formed in a second portion therein located adjacent to a second side of said bay, and a third opening located at a centre portion therein.

4. A puzzle game according to claim 3 wherein said first portion, second portion and centre portion of said shaft member have a larger diameter than remaining portions of said shaft member.

5. A puzzle game according to claim 4 including a first sleeve member located at said first portion, a second sleeve member located at said second portion, and a third sleeve member located at said centre portion of said shaft member, said first sleeve member having an end portion therein disposed in a spaced manner from a portion of said remaining portion of said shaft member and forming a first annular gap therein, said second sleeve member having an end portion therein disposed in a spaced manner from another portion of said remaining portion of said shaft member and forming a second annular gap therein, and said third sleeve member having two end portions therein disposed in a spaced manner from two portions of said remaining portions of said shaft member and forming a third annular gap and a fourth annular gap therein respectively between said two end portions of said third sleeve member and said centre portion of said shaft member.

6. A puzzle game according to claim 5 wherein each of said first sleeve member, second sleeve member and third sleeve member includes a first semi-cylindrical cover member mounted on said upper semi-cylindrical portion of said shaft member, and a second semi-cylindrical cover member mounted on said lower semi-cylindrical portion of said shaft member.

7. A puzzle game according to claim 6 wherein said first annular gap includes a first upper arcuate gap disposed in said upper inverted saucer and a second arcuate gap disposed in said lower saucer, said second annular gap includes a third arcuate gap and fourth arcuate gap respectively disposed in said upper inverted saucer and lower saucer, and said third annular gap includes a fifth arcuate gap and sixth arcuate gap respectively disposed in said upper inverted saucer and said lower saucer, and said fourth annular gap includes a seventh arcuate gap disposed in said upper inverted saucer and an eighth arcuate gap disposed in said lower saucer.

8. A puzzle game according to claim 7 each sector of said spherical members including a base portion having an arcuate plate therein, a first pair of said sectors being movably mounted on said shaft member with their arcuate plate therein slidably engaging with said first arcuate gap and third arcuate gap in said upper inverted saucer, a second pair of said sectors being movably mounted on said shaft member with their arcuate plate therein slidably engaging with said fourth arcuate gap and sixth arcuate gap in said upper inverted saucer, a third pair of said sectors being movably mounted on said shaft member with their arcuate plate therein slidably engaging with said second arcuate gap and fourth arcuate gap in said lower saucer, and a fourth pair of said sectors being movably mounted on said shaft member with their arcuate plate therein slidably engaging with said fifth arcuate gap and seventh arcuate gap in said lower saucer.

9. A puzzle game according to claim 8 wherein each of said first semi-cylindrical cover member, second semi-cylindrical cover member and third semi-cylindrical cover member includes two longitudinal grooves formed on a top surface therein, said sectors include a projection disposed in a spaced manner above said arcuate plate therein, said projection being engageable with a selected one of said two longitudinal grooves to retain said sectors in a selected position when a spherical member is rotated relative to a respective shaft member.

10. A puzzle game according to claim 9 including detent projections formed in said upper inverted saucer and associated detent depressions formed in said lower saucer, said detent projections and associated detent depressions being engageable with one another when said upper inverted saucer and lower saucer are rotated with respect of each other for temporarily retaining said upper inverted saucer and lower saucer in selected positions in which selected bays in said upper inverted saucer are aligned with selected bays in said lower saucer.

11. A puzzle game according to claim 10 wherein said spherical members have different colours.

12. A puzzle game according to claim 11 wherein said spherical members have different patterns provided on the surface of the sectors therein.

13. A puzzle game comprising, an upper inverted saucer and a lower saucer rotatably mounted together with respect to a central axis mounted at the centre of said upper inverted saucer and said lower saucer, three semi-circular bays formed in even intervals in the periphery of each of said upper inverted saucer and additional three semi-circular bays also formed in even intervals in the said lower saucer, said semi-circular bays and additional semi-circular bays being equal in dimension to one another and having a front opening facing outwards from said periphery, a semi-cylindrical shaft member disposed at the diameter of each of said semi-circular bays and extending across said front opening in said upper inverted saucer, and an associated semi-cylindrical shaft member disposed at the diameter of each of said semi-circular bays and extending across said front opening in said lower saucer, said semi-cylindrical shaft member having a curved upper surface and a substantially flat bottom surface, said associated semi-cylindrical shaft member having a curved lower surface and a substantially flat upper surface, three semi-spherical members located in said three semi-circular bays in said upper inverted saucer wherein each semi-spherical member comprises four equal sectors rotatably mounted to said semi-cylindrical shaft member in said semi-circular bays in said upper inverted saucer, three additional semi-spherical members located in said three semi-circular bays in said lower saucer wherein each additional semi-spherical member is equal in dimension to said semi-spherical members in said upper inverted saucer and comprises four equal sectors rotatably mounted to said associated semi-cylindrical shaft member in said lower saucer, said upper inverted saucer being rotatable relative to said lower saucer for aligning said semi-spherical members in said upper inverted saucer and said additional semi-spherical members in said lower saucer for forming three spheres, each one of said spheres being rotatable with respect to the combination of said semi-cylindrical shaft member and associated semi-cylindrical shaft member for moving a first pair of said sectors in a semi-spherical member from said upper inverted saucer to said lower saucer while a second pair of said sectors in an additional semi-spherical member in said lower saucer and located diametrically opposite to said first pair of said sectors is being moved from said lower saucer to said upper inverted saucer.

14. A puzzle game according to claim 13 wherein each semi-cylindrical shaft member includes a left section, a centre section and a right section having a larger diameter than remaining sections therein, and each associated semi-cylindrical shaft member also includes a left section, a centre section, and a right section having a larger diameter than remaining section therein.

15. A puzzle game according to claim 14 including a first semi-annular cover member mounted over said left section of said semi-cylindrical shaft member, a second semi-annular cover member mounted over said centre section of said semi-cylindrical shaft member, a third semi-annular cover member mounted over said right section of said semi-cylindrical shaft member in said upper inverted saucer, a fourth semi-annular cover member mounted over said left section of said associated semi-cylindrical shaft member, a fifth semi-annular cover member mounted over said centre section of said associated semi-cylindrical shaft member, and a sixth semi-annular cover member mounted over said right section of said associated semi-cylindrical shaft member in said lower saucer.

16. A puzzle game according to claim 15 including a first annular gap formed between an end portion of said first semi-annular cover member and said semi-cylindrical shaft member, a second annular gap formed between one end portion of said second semi-annular cover member and said semi-cylindrical shaft member, a third annular gap formed between a second end portion of said second semi-annular cover member and said semi-cylindrical shaft member, a fourth annular gap formed between an end portion of said third semi-annular cover member and said semi-cylindrical shaft member, each one of said sectors in said semi-spherical member having an arcuate plate member located at a convergent portion therein, one pair of said sectors being rotatably mounted on said semi-cylindrical shaft member by slidably engaging said arcuate plate member therein with said first annular gap and said second annular gap, a second pair of said sectors being rotatably mounted on said semi-cylindrical shaft member by slidably engaging said arcuate plate member therein with said third annular gap and fourth annular gap.

17. A puzzle game according to claim 16 including a fifth annular gap formed between an end portion of said fourth semi-annular cover member and said associated semi-cylindrical shaft member, a sixth annular gap formed between one end portion of said fifth semi-annular cover member and said associated semi-cylindrical shaft member, a seventh annular gap formed between a second end portion of said fifth semi-annular cover member and said associated semi-cylindrical shaft member, and an eighth annular gap formed between an end portion of said sixth semi-annular cover member and said associated semi-cylindrical shaft member, each one of said sectors in said additional semi-spherical member having an arcuate plate member located at a convergent portion therein, one pair of said sectors of said additional semi-spherical member being rotatably mounted on said associated semi-cylindrical shaft member by slidably engaging said arcuate plate member therein with said fifth annular gap and said sixth annular gap, a second pair of said sectors in said additional semi-spherical member being rotatably mounted on said associated semi-cylindrical shaft member by slidably engaging said arcuate plate member therein with said seventh annular gap and said eighth annular gap.

18. A puzzle game according to claim 17 wherein said three semi-spherical members in said upper inverted saucer are of three different colours, and said three additional semi-spherical member in said lower saucer are of the same three different colours.

19. A puzzle game according to claim 18 including two longitudinal detent grooves formed on said second semi-annular cover member, and two additional detent grooves formed on said fifth semi-annular cover member, a projection disposed in a spaced manner above said arcuate plate member in said sectors of said semi-spherical members and said additional semi-spherical members, said projection in said sectors of said semi-spherical members being operative to engage with a selected one of said two longitudinal detent grooves to temporarily maintaining said semi-spherical members at a selected rotatable position, and said projection in said sectors of said additional semi-spherical members being operative to engage with a selected one of said two additional detent grooves to temporarily maintaining said additional semi-spherical member at a selected rotatable position.

* * * * *